US011092298B2

(12) United States Patent
Barak

(10) Patent No.: US 11,092,298 B2
(45) Date of Patent: Aug. 17, 2021

(54) ELECTRICAL APPLIANCE CEILING SUSPENSION

(71) Applicant: Shimshon Barak, Rishon-Lezion (IL)

(72) Inventor: Shimshon Barak, Rishon-Lezion (IL)

( * ) Notice: Subject to any disclaimer, the term of this patent is extended or adjusted under 35 U.S.C. 154(b) by 110 days.

(21) Appl. No.: 16/563,883

(22) Filed: Sep. 8, 2019

(65) Prior Publication Data

US 2020/0400280 A1 Dec. 24, 2020

(30) Foreign Application Priority Data

Jun. 23, 2019 (IL) ..... 267595

(51) Int. Cl.

| | |
|---|---|
| ***H01R 13/60*** | (2006.01) |
| ***H01R 13/66*** | (2006.01) |
| ***F21S 8/06*** | (2006.01) |
| ***F21V 23/06*** | (2006.01) |
| ***F04D 25/08*** | (2006.01) |
| ***H01R 33/00*** | (2006.01) |
| ***F21V 21/03*** | (2006.01) |

(52) U.S. Cl.

CPC ..... *F21S 8/063* (2013.01); *F04D 25/088* (2013.01); *F21V 21/03* (2013.01); *F21V 23/06* (2013.01); *H01R 33/00* (2013.01)

(58) Field of Classification Search

CPC ..... H02G 3/20; F21V 21/03; F04D 25/088; E21B 43/128

USPC ..... 439/537, 576

See application file for complete search history.

(56) References Cited

U.S. PATENT DOCUMENTS 5,009,384 A * 4/1991 Gerke ..... B60R 11/0229 248/317
6,135,814 A * 10/2000 Fischer ..... F21V 21/03 439/529
6,503,099 B2 * 1/2003 Kerr, Jr. ..... F21V 21/02 439/537
6,638,103 B2 * 10/2003 Pasternak ..... H01R 13/2421 439/537
6,780,049 B1 * 8/2004 D'Angelo ..... F04D 29/601 439/313
6,799,982 B2 * 10/2004 Kerr, Jr. ..... F21V 23/06 439/180
7,165,992 B1 * 1/2007 Schiaffino ..... H01R 13/213 439/537
7,192,303 B2 * 3/2007 Kohen ..... F21V 21/03 439/135

(Continued)

*Primary Examiner* — Abdullah A Riyami
*Assistant Examiner* — Thang H Nguyen
(74) *Attorney, Agent, or Firm* — Alphapatent Associates, Ltd; Daniel J. Swirsky

(57) ABSTRACT

A ceiling suspension, including a first member, including physical and electrical connectors for being physically and electrically fixed to the ceiling, a second member, including physical and electrical connectors, for being physically and electrically connected to an electrical appliance, where the first and second members include complementary electrical connectors, being configured for electrically connecting one another upon completing horizontal sliding of the second member in relation to the first member being fixed to the ceiling, and where the first and second members include complementary physical connectors, being configured for supporting the second member by the first member upon completing the horizontal sliding of the second member.

3 Claims, 4 Drawing Sheets

(56) References Cited

U.S. PATENT DOCUMENTS

| | | | | |
|---|---|---|---|---|
| 7,753,722 | B2 * | 7/2010 | Simonse | H04R 1/06<br>439/537 |
| 8,025,528 | B2 * | 9/2011 | Smith | F16M 11/041<br>439/537 |
| 2005/0272306 | A1 * | 12/2005 | Kerr, Jr. | F04D 29/601<br>439/537 |
| 2010/0227499 | A1 * | 9/2010 | Ramos | F21V 21/38<br>439/537 |

* cited by examiner

ELECTRICAL APPLIANCE CEILING SUSPENSION

CROSS-REFERENCE TO RELATED APPLICATIONS

This application claims the benefit of priority from Israel Application No. 267595, filed Jun. 23, 2019, the disclosure of which is incorporated herein by reference.

TECHNICAL FIELD

The invention relates to the field of light and fans fixtures. More particularly, the invention relates to a suspension extending from the ceiling.

BACKGROUND

There is a long felt need to provide a non-professional an accessory for mounting a light fixture or a fan to the ceiling.

SUMMARY

A ceiling suspension, including:
a stationary member;
a mobile member,
wherein the members include complementary electrical connectors, and complementary physical connectors, for supporting the mobile member by the stationary member upon completing the horizontal sliding of the second member.

BRIEF DESCRIPTION OF THE DRAWINGS

Embodiments, features, and aspects of the invention are described herein in conjunction with the following drawings.

The drawings are not necessarily drawn to scale.

DETAILED DESCRIPTION

The invention will be understood from the following detailed description of embodiments of the invention, which are meant to be descriptive and not limiting. For the sake of brevity, some well-known features are not described in detail.

The reference numbers have been used to point out elements in the embodiments described and illustrated herein, in order to facilitate the understanding of the invention. They are meant to be merely illustrative, and not limiting. Also, the foregoing embodiments of the invention have been described and illustrated in conjunction with systems and methods thereof, which are meant to be merely illustrative, and not limiting.

Figure 1:
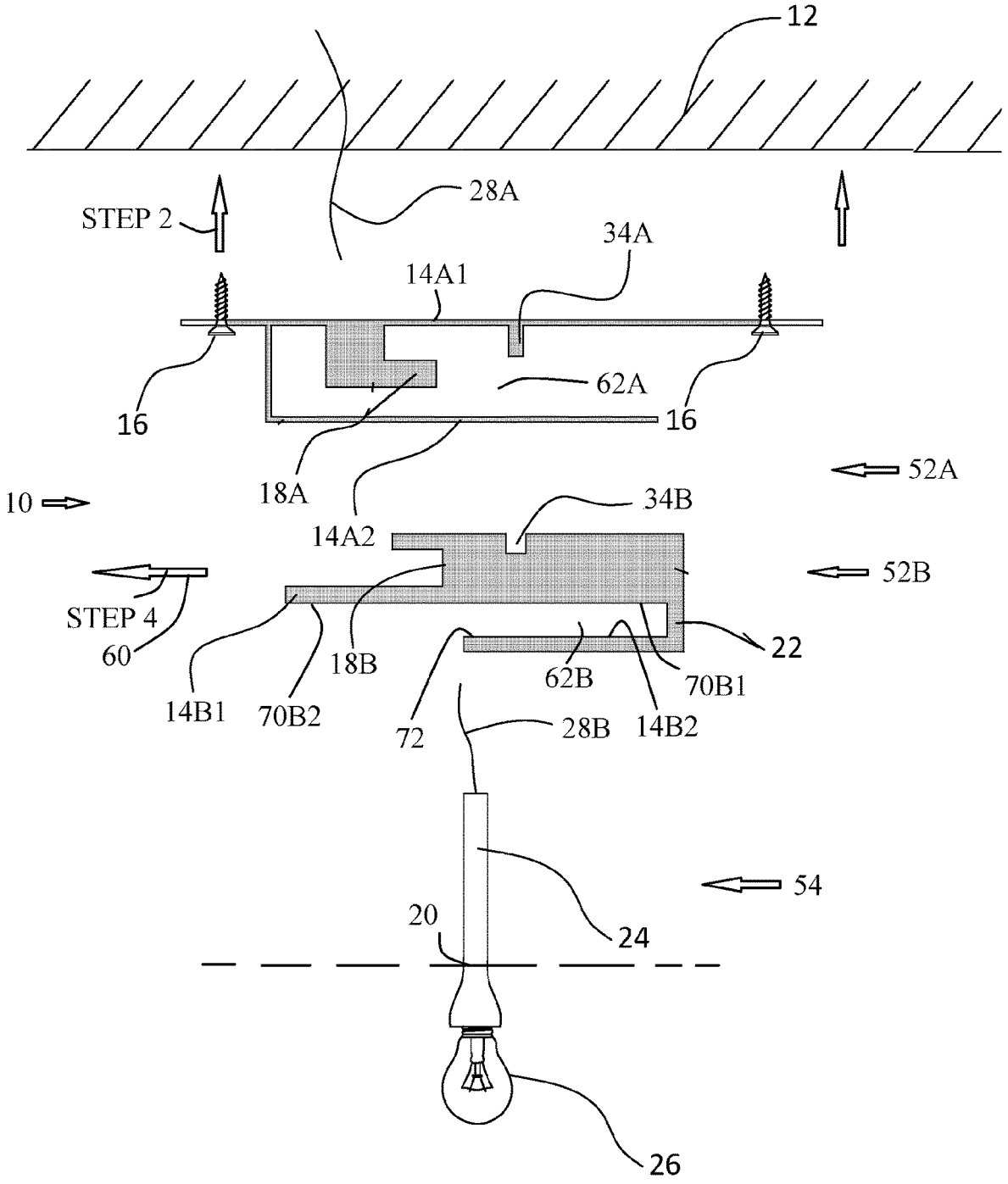
FIG. 1 is a front view of a ceiling suspension according to one embodiment, the ceiling and an electrical appliance.

FIG. 1 is a front view of a ceiling suspension according to one embodiment, the ceiling and an electrical appliance.

A ceiling suspension 10 according to one embodiment of the invention, includes a stationary member 52A and a mobile member 52B.

Figure 2:
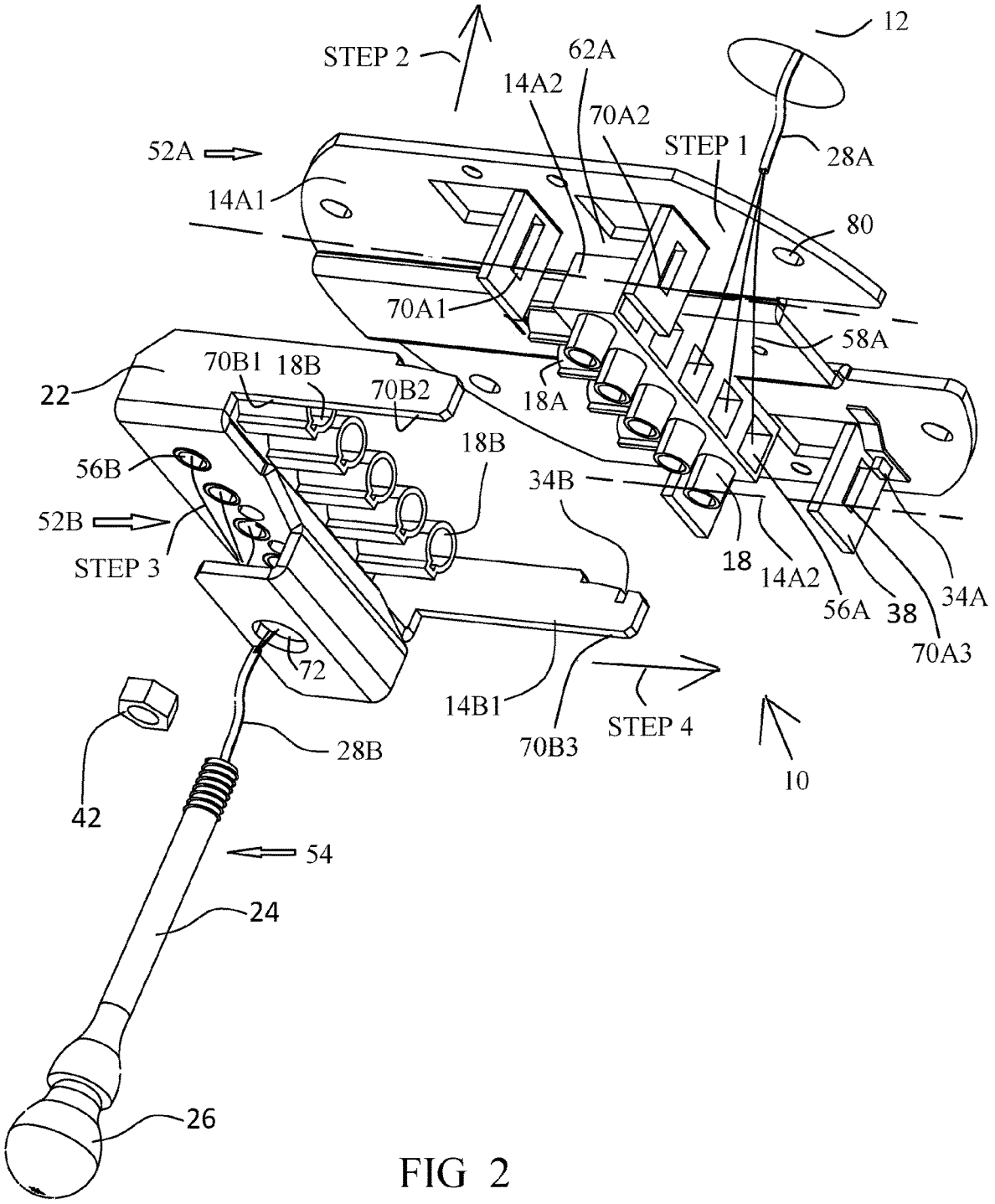
FIG. 2 is a perspective view of the ceiling suspension of FIG. 1, according to one embodiment, the ceiling and the electrical appliance.

FIG. 2 is a perspective view of the ceiling suspension of FIG. 1, according to one embodiment, the ceiling and the electrical appliance.

At the first step, the user connects wires 58A of electric cable 28A extending from ceiling 12, to electrical sockets 56A of stationary member 52A, being fixed to plugs 18A of stationary member 52A.

At the second step, the user fixes a top horizontal plane 14A1 of stationary member 52A to the ceiling 12 by screws 16, disposed horizontally at the end of horizontal plane 14A1.

At the third step, the user connects wires of electric cable 28B extending from electric appliance 54, to electrical sockets 56B of mobile member 52B, being fixed to sockets 18B of mobile member 52B.

At the fourth step, and referring again to FIG. 1, the user horizontally 60 slides electrical sockets 18A of mobile member 52B, for inserting them into electrical plugs 18A of stationary member 52A.

Referring yet to FIG. 1, stationary member 52A includes another horizontal plane 14A2, being disposed below top horizontal plane 14A1, for supporting a horizontal plane 14B1 of mobile member 52B.

Figure 3:
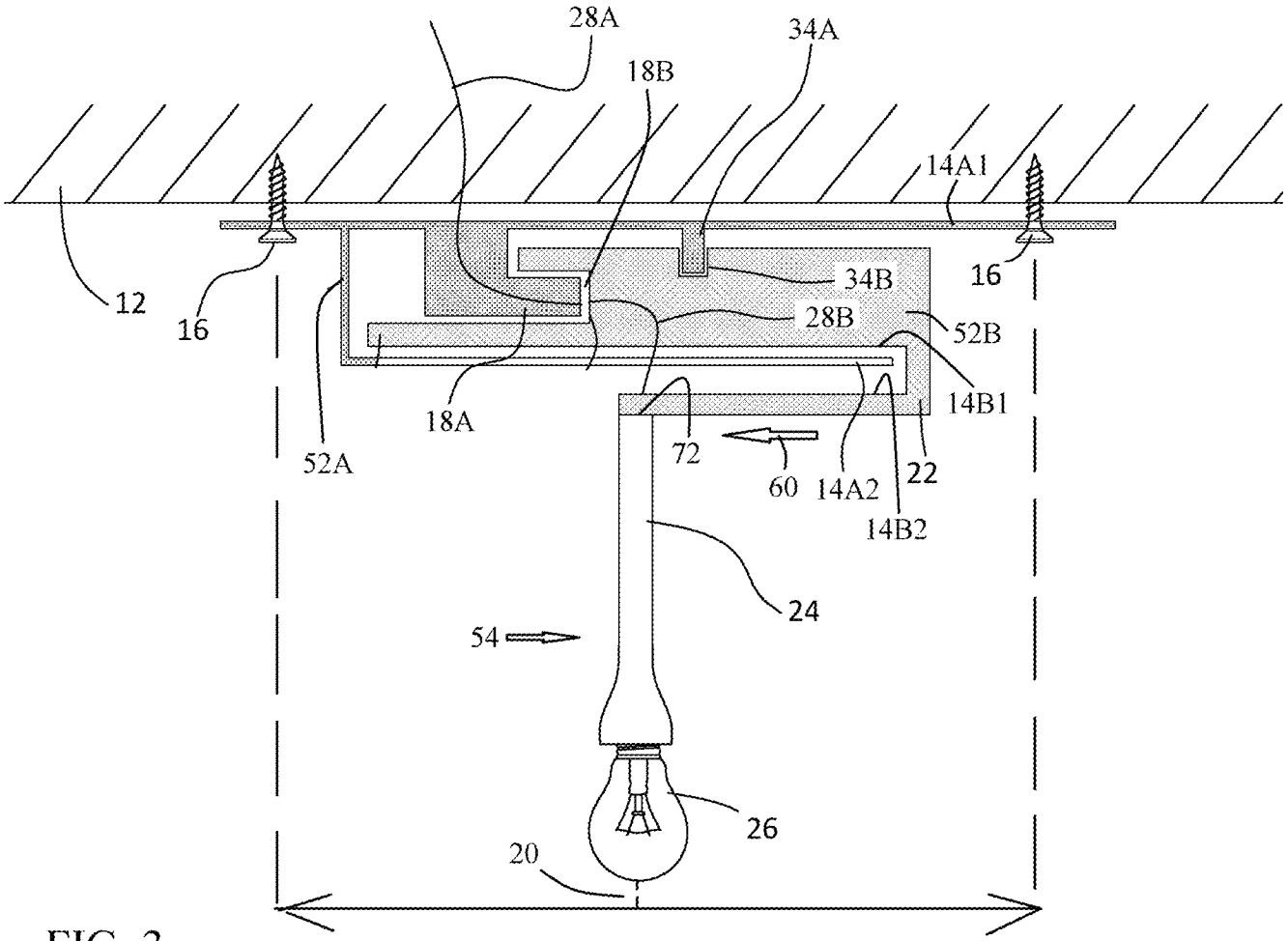
FIG. 3 is the front view of the ceiling suspension of FIG. 1, being fixed to the ceiling and connected to the electrical appliance.

FIG. 3 is the front view of the ceiling suspension of FIG. 1, being fixed to the ceiling and connected to the electrical appliance.

Thus, horizontal sliding 60 of the fourth step, supports horizontal plane 14B1 of mobile member 52B on top of horizontal plane 14A2 of stationary member 52A, and further inserts sockets 18B of mobile member 52B into plugs 18A of stationary member 52A.

Horizontal plane 14A2 of stationary member 52A and horizontal plane 14B1 of mobile member 52B may include vertical complementary male and female members, such as vertical female member 34B of mobile member 52B for being inserted into vertical male member 34A of stationary member 52A, for locking the position of FIG. 3, as removal of mobile member 52B requires lifting thereof.

The term "horizontal virtual plane" refers herein to at least three points describing a horizontal plane.

Referring again to FIG. 2, any of horizontal planes 14A1, 14A2 and 14B1 may be virtual. For example, horizontal plane 14A2 of stationary member 52A may include points 70A1, 70A2, 70A3, etc. for supporting points 70B1, 70B2, 70B3, etc. being horizontal plane 14B1 of mobile member 52B.

Referring again to FIG. 3, in spite of plane 14A2 of stationary member 52A being disposed below plane 14B1 of mobile member 52B for supporting plane 14B1, electric appliance 54 is supported by a supporting point 72 being disposed below plane 14B1 of mobile member 52B and being horizontally disposed at the center 20 between screws 16, thereby providing that electric appliance 54 is disposed horizontally at the center of the mass, for applying minimal vertical force on screws 16.

In the embodiment of FIGS. 1 and 3, the center disposition 20 of supporting point 72 is obtained, in spite of plane 14A2 of stationary member 52A being disposed below plane 14B1, by extending supporting point 72 from a horizontal plane 14B2, extending from the end 22 of horizontal plane 14B1.

In the embodiment of FIG. 2, the center disposition of supporting point 72 is obtained, in spite of plane 14A2 of stationary member 52A being disposed below plane 14B1, by extending supporting point 72 directly through horizontal plane 14B1, since being virtual only.

Figure 4:
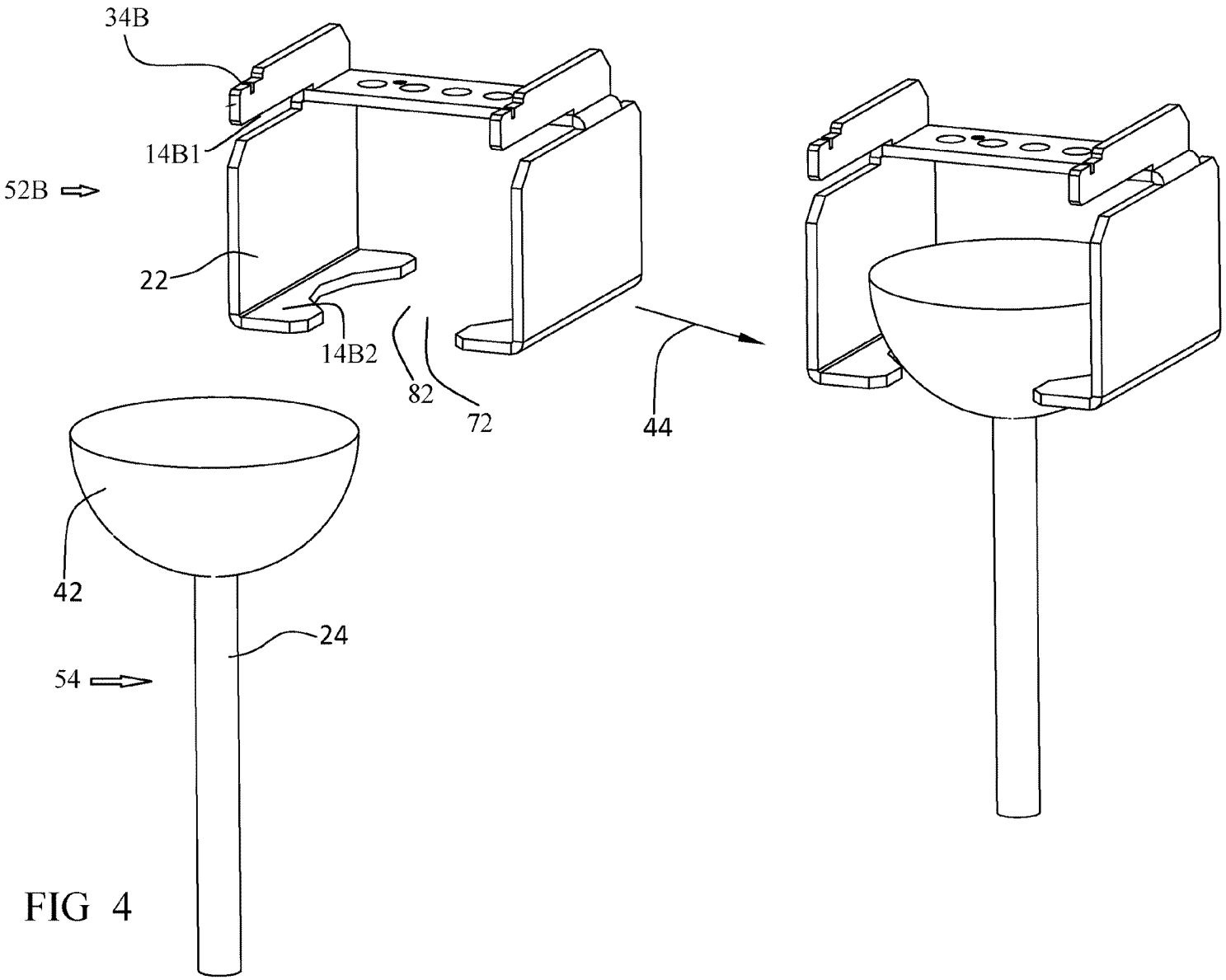
FIG. 4 depicts another hanging of the electric appliance.

FIG. 4 depicts another hanging of the electric appliance.

A hole 82 being smaller than the top body 42 of electrical appliance 54, may further accompany the mounting.

The non-professional may easily remove any electrical appliance 54, including mobile member 52B, from stationary member 52A, for connecting thereto any other electrical appliance 54, including mobile member 52B.

Thus, in one aspect, the invention is directed to a ceiling suspension (10), including:

a first member (52A), including physical (80) and electrical (56A) connectors for being physically and electrically fixed to the ceiling;

a second member (52B), including physical (72) and electrical (56B) connectors, for being physically and electrically connected to an electrical appliance (54), where the first (52A) and second (52B) members include complementary electrical connectors (18A,18B), being configured for electrically connecting one another upon completing horizontal sliding (60) of the second member (52B) in relation to the first member (52A) being fixed to the ceiling, and where the first (52A) and second (52B) members include complementary physical connectors (14A1,14A2), being configured for supporting the second member (52B) by the first member (52A) upon completing the horizontal sliding (60) of the second member (52B).

The physical connector (72) of the second member (52B) may be configured to be disposed below the physical connector (14A2) of the first member (52A) at the horizontal center (20) thereof, upon completing the horizontal sliding of the second member (52B).

The first (52A) and second (52B) members may further include complementary vertical members (34A,34B), being configured for physically vertically connecting one another upon the completing of the horizontal sliding (60) of the second member (52B), thereby removal of the mobile member (52B) from the stationary member (52A) requires lifting of the mobile member (52B).

The physical (72) connector of the second member (52B) for being physically connected to the electrical appliance (54), may include a hole (82) being smaller than the top body (42) of the electrical appliance (54), thereby the physical connecting (44) of the electrical appliance (54) to the second member (52B) applies hanging the top body (42) on the hole (82).

In the figures and/or description herein, the following reference numerals (Reference Signs List) have been mentioned:

numeral 10 denotes the ceiling suspension according to one embodiment of the invention;

12: ceiling;

14A1,14A2,14B1,14B2: physical connectors for supporting mobile member 52B by gravity on stationary member 52A; the connectors may be horizontal planes, being physical or virtual, for supporting one another;

16: screw or another fastener;

18A,18B: male and female electric connectors;

20: horizontally center disposition of point 72 supporting top 42 of rod 24 of electrical appliance 54;

22: end connecting two horizontal planes, thereby forming a gap therebetween;

24: vertical rod of electrical appliance 54;

26: bulb;

28A,28B: electric cables;

34A,34B: male and female vertical members, for locking one another;

42: top body of electrical appliance 54, being hung, which may be the top screw;

44: connecting electrical appliance 54 to mobile member 52B;

52A: stationary member;

52B: mobile member;

54: electrical appliance, such as lamp or fan;

56A,56B: electrical connectors such as sockets of members 52A,52B respectively;

58A: wire of cable 28A;

58B: wire of cable 28B;

60: horizontal sliding of mobile member 52B;

62A,62B: horizontal gaps between horizontal planes, for inserting other horizontal planes thereinto;

70A1,70A2,70A3,70B1,70B2,70B3: points of connectors 14A1,14A2,14B1,14B2;

72: point supporting electrical appliance 54;

80: physical connector of stationary member 52A, being typically a hole for inserting screw 16;

The foregoing description and illustrations of the embodiments of the invention have been presented for the purpose of illustration, and are not intended to be exhaustive or to limit the invention to the above description in any form.

Any term that has been defined above and used in the claims, should to be interpreted according to this definition.

The reference numbers in the claims are not a part of the claims, but rather used for facilitating the reading thereof. These reference numbers should not be interpreted as limiting the claims in any form.

What is claimed is:

1. A ceiling suspension, comprising:

a first member, comprising physical and electrical connectors for being physically and electrically fixed to the ceiling;

a second member, comprising physical and electrical connectors, for being physically and electrically connected to an electrical appliance, wherein said first and second members comprise complementary horizontal electrical connectors, being configured for electrically connecting one another upon completing horizontal straight sliding of said second member in relation to said first member being fixed to the ceiling;

complementary physical horizontal connectors being configured for supporting said second member by said first member upon said completing said horizontal straight sliding of said second member, and complementary physical vertical members, extending from said physical horizontal connectors and being configured for physically vertically connecting one another upon said completing said horizontal straight sliding of said second member and not for electrically connecting one another, wherein said electrical connectors are not said physical horizontal connectors and are not said physical vertical members, thereby connecting said first and second members one to the other is applyable by said horizontal straight sliding of said second member, whereas removal of said second member from said first member requires lifting of said second member followed by horizontal sliding thereof.

2. The ceiling suspension according to claim 1, wherein said physical connector of said second member is configured to be disposed below said physical connector of said first member at a horizontal center thereof, upon said completing said horizontal sliding of said second member.

3. The ceiling suspension according to claim 1, wherein said physical connector of said second member for being physically connected to said electrical appliance, comprises a hole being smaller than a top body of said electrical appliance, thereby said physical connecting of said electrical appliance to said second member comprises hanging said top body on said hole.

* * * * *